US005526030A

United States Patent [19]

Baldwin et al.

[11] Patent Number: 5,526,030

[45] Date of Patent: Jun. 11, 1996

[54] PRESSURE CONTROL APPARATUS FOR AN INK PEN

[75] Inventors: Marc A. Baldwin, Corvallis; Ella M. Duyck, Philomath; Mark L. McCarty, Corvallis; Lowell R. McDaniel, Corvallis; John M. Altendorf, Corvallis; Joseph R. Elliot, Corvallis; Bruce Cowger, Corvallis, all of Oreg.

[73] Assignee: Hewlett-Packard Company, Palo Alto, Calif.

[21] Appl. No.: 957,534

[22] Filed: Oct. 5, 1992

[51] Int. Cl.[6] ..... B41J 2/175

[52] U.S. Cl. ..... 347/87

[58] Field of Search ..... 346/1.1, 140 R; 220/205, 240, 89.1, 89.2; B41J 2/175

[56] References Cited

U.S. PATENT DOCUMENTS

| | | | |
|---|---|---|---|
| 2,587,949 | 3/1952 | Zodtner . | |
| 3,296,624 | 1/1967 | Ascoli | 346/140 R |
| 3,438,058 | 4/1969 | Davis | 346/140 R |
| 3,452,361 | 6/1969 | Williams, Jr. | 346/140 R |
| 4,149,172 | 4/1979 | Heinzl et al. | 346/140 R |
| 4,207,012 | 6/1980 | Kuparinen | 401/258 |
| 4,217,058 | 8/1980 | Straszewski et al. | 401/135 |
| 4,272,773 | 6/1981 | Halasz | 346/140 R |
| 4,342,042 | 7/1982 | Cruz-Uribe et al. | 346/140 R |
| 4,382,707 | 5/1983 | Anderka | 401/198 |
| 4,412,232 | 10/1983 | Weber et al. | 346/140 R |
| 4,422,084 | 12/1983 | Saito | 346/140 R |
| 4,509,062 | 4/1985 | Low et al. | 346/140 R |
| 4,620,202 | 10/1986 | Koto et al. | 346/140 R |
| 4,671,692 | 6/1987 | Inaba | 401/199 |
| 4,677,447 | 6/1987 | Nielsen | 346/140 R |
| 4,689,642 | 8/1987 | Sugitani | 346/140 R |
| 4,709,245 | 11/1987 | Piatt | 346/140 R |
| 4,709,247 | 11/1987 | Piatt et al. | 346/140 R |
| 4,714,937 | 12/1987 | Kaplinsky | 346/140 R |
| 4,771,295 | 9/1988 | Baker et al. | 346/1.1 |
| 4,777,497 | 10/1988 | Nozu et al. | 346/140 R |
| 4,785,314 | 11/1988 | Terasawa et al. | 346/140 R |
| 4,794,409 | 12/1988 | Cowger et al. | 346/140 R |
| 4,806,032 | 2/1989 | Gragg et al. | 220/205 X |
| 4,920,362 | 4/1990 | Cowger | 346/140 R |
| 4,931,812 | 6/1990 | Dunn et al. | 346/140 A |
| 4,992,802 | 2/1991 | Dion et al. | 346/1.1 |
| 5,040,002 | 8/1991 | Pollacek et al. | 346/140 R |
| 5,047,790 | 9/1991 | Cowger et al. | 346/140 R |
| 5,153,612 | 10/1992 | Dunn et al. | 346/140 R |

FOREIGN PATENT DOCUMENTS

| | | | |
|---|---|---|---|
| 0509686A2 | 10/1992 | European Pat. Off. . | |
| 0529880A2 | 3/1993 | European Pat. Off. . | |
| 2063175 | 6/1981 | United Kingdom | B41J 2/175 |

*Primary Examiner*—Benjamin R. Fuller
*Assistant Examiner*—Alrick Bobb

[57] ABSTRACT

The back pressure of an ink pen is maintained by providing a capillary member adjacent a bubble generator. Regardless of the orientation of the pen, the capillary member maintains a quantity of ink adjacent an orifice defined by the bubble generator. The quantity of ink serves to supply a liquid seal formed in the orifice. As the back pressure within the ink pen rises to its maximum level, the liquid seal within the orifice is overcome and ambient air bubbles into the reservoir to lower the back pressure. As the back pressure returns to a desirable point, ink trapped by the capillary member enters the orifice to reseal the orifice.

16 Claims, 5 Drawing Sheets

PRESSURE CONTROL APPARATUS FOR AN INK PEN

BACKGROUND OF THE INVENTION

1. Field of the Invention

The present invention relates to ink pens for ink-jet printers, and more particularly, to an apparatus for controlling the pressure within the reservoir of an ink pen.

2. Description of Related Art

Ink-jet printers have become established as reliable and efficient printing devices. Typically, an ink-jet printer, utilizes a print head which is moved relative to a printing surface. A control system activates the moving print head at the appropriate locations causing the print head to eject, or jet, ink drops onto the printing surface to form desired images and characters. Such printers typically include an ink pen which serves as a reservoir for storing ink and provides a means of supplying ink, as needed, to the print head.

There are two commonly used systems for ejecting ink from a print head. The first is a thermal bubble system and the second is a piezoelectric system. A print head using either system typically includes a plurality of orifices, each orifice having an associated chamber. In operation, ink is supplied via an inlet to the chamber. Upon activation, the ink is forced, or jetted, from the chamber through the orifice and onto the printing surface. In thermal bubble type print heads, the ink in the chamber is heated or vaporized, typically by a thin film resistor. The rapid expansion which results from vaporization of the ink forces a quantity of ink from the chamber through the orifice. In piezoelectric type print heads, a piezoelectric element creates a pressure wave within the chamber which ejects a quantity of ink through the orifice.

Although both thermal bubble and piezoelectric print heads provide a reliable and efficient means of jetting ink from an orifice, both types of print heads generally have no mechanism to prevent the free flow of ink through the orifice when the print head is not activated. If this occurs, ink may leak, or drool, uncontrollably onto the printing surface to produce an undesirable ink spot. In addition, leaking ink may build up on the print head and impair the proper operation of the print head.

To alleviate these problems, many ink-jet printers supply ink from the ink pen to the print head at a slight underpressure or back pressure. As used herein a positive back pressure is used to refer to a pressure within an ink pen that is lower than the ambient pressure surrounding the print head orifice.

To be effective, the back pressure must be maintained within a desired operating range. That is, the back pressure must be large enough to prevent the unwanted free flow of ink through the orifice. At the same time, the back pressure must be small enough that the print head, when activated, can overcome the back pressure and eject the ink in a consistent and predictable manner. To meet these constraints and provide optimum operation of the ink-jet printer, a fairly constant and predictable back pressure should be maintained.

The back pressure of an ink pen is affected by changes in either the ambient pressure or the internal pressure. For example, if an ink pen is subject to an increase in altitude, such as during transport aboard an aircraft, the ambient pressure may decrease substantially. Unless the back pressure of the ink pen increases accordingly, the ambient pressure level may drop below that of the back pressure and ink will likely leak from the print head. In addition, as ink is depleted from the ink pen reservoir the back pressure within the ink pen will tend to increase. Without some mechanism for compensating for this, the back pressure may exceed the operating range of the print head and the ink pen will become inoperative. Temperature variations may cause the ink and air within the ink pen to contract or expand, thereby affecting the back pressure. All of these factors must be accounted for in order to ensure consistent trouble-free operation of the ink-jet printer.

One type of ink pen uses a variable volume reservoir to solve these problems. For example, the reservoir may be of a flexible material which can expand or contract. Alternatively, the reservoir may have sleeve and piston configuration or utilize an expandable bladder as an internal accumulator. In this type of ink pen, as the volume of ink within the reservoir varies due to depletion, thermal variations, or the like, the volume of the reservoir also varies. Although a significant improvement over previous ink pens, such devices suffer from certain drawbacks.

For example, such devices do not necessarily provide a constant back pressure. Rather, a reservoir with a freely variable volume will tend to maintain an internal reservoir pressure which is equal to the ambient pressure, that is, zero back pressure. To overcome this problem, many variable volume reservoirs use a resilient member, such as a spring, to constantly urge the reservoir toward an increased volume. In this manner, the desired back pressure is created.

Because variable volume reservoirs inherently have maximum and minimum limitations on the size of the reservoir, they are typically least effective when the ink pen is either nearly full or nearly empty. For example, if a new ink pen with a variable volume reservoir is filled to capacity with ink, the reservoir is unable to further expand in response to back pressure changes. As a result, if the fluid volume within the reservoir expands due to a change in back pressure, a quantity of ink may be forced out through the print head. To compensate for this many new pens are not completely filled with ink. Even more significant, variable volume reservoirs typically have a minimum volume which is greater than zero. As the pen nears depletion and the reservoir shrinks to this minimum volume, further ink depletion raises the back pressure above the operating range of the print head. As a result, a quantity of unusable ink will remain in each discarded pen.

To reduce this problem, some ink pens incorporate a "bubble generator." A bubble generator is an orifice formed in the ink reservoir of an ink pen to allow fluid communication between the interior of the reservoir and the ambient atmosphere. The orifice is sized such that the capillarity of the ink normally retains a small quantity of ink in the orifice as a liquid seal. The geometry of the orifice is such that when the back pressure approaches the limit of the operating range of the print head the back pressure overcomes the capillarity of the ink and the liquid seal is broken. Ambient air then "bubbles" into the reservoir to reduce the back pressure. Ideally, when the back pressure drops, ink from the reservoir reenters the orifice and reinstates the liquid seal.

However, if the seal breaks and the orifice is not submerged, there is no ink to reinstate the seal and the back pressure may be lost. In addition, if the ink level drops or the pen is oriented in such a manner that the orifice is above the ink level within the reservoir, the liquid seal may weaken and fail over time. This would permit the free flow of ambient air into the reservoir, eliminate the back pressure, and allow the ink pen to drool.

SUMMARY OF THE INVENTION

Accordingly, it is an object of the present invention to provide an ink pen having a mechanism for maintaining a back pressure within the operating range of the print head.

It is a further object of the invention to provide a mechanism for regulating the pressure in an ink pen that allows for the efficient extraction of ink from the pen and minimizes the amount of unusable ink which is discarded with an ink pen that stops printing because the back pressure exceeded the operating range.

It is another object of the invention to provide a mechanism for regulating the pressure in an ink pen that operates reliably and consistently regardless of pen orientation.

It is a further object of the invention to provide a pressure regulating mechanism for an ink pen that is easy and inexpensive to manufacture and has few complicated parts.

An ink pen in accordance with one aspect of the present invention has a reservoir for holding a supply of ink. The reservoir is provided with an orifice allowing fluid communication between the reservoir and a make up fluid, such as ambient atmosphere. A capillary member is positioned to retain a quantity of ink adjacent the orifice regardless of the pen orientation or ink level within the reservoir. The retained quantity of ink provides a liquid seal that seals the orifice and yet allows bubbles to pass through the seal to regulate the pressure within the reservoir.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
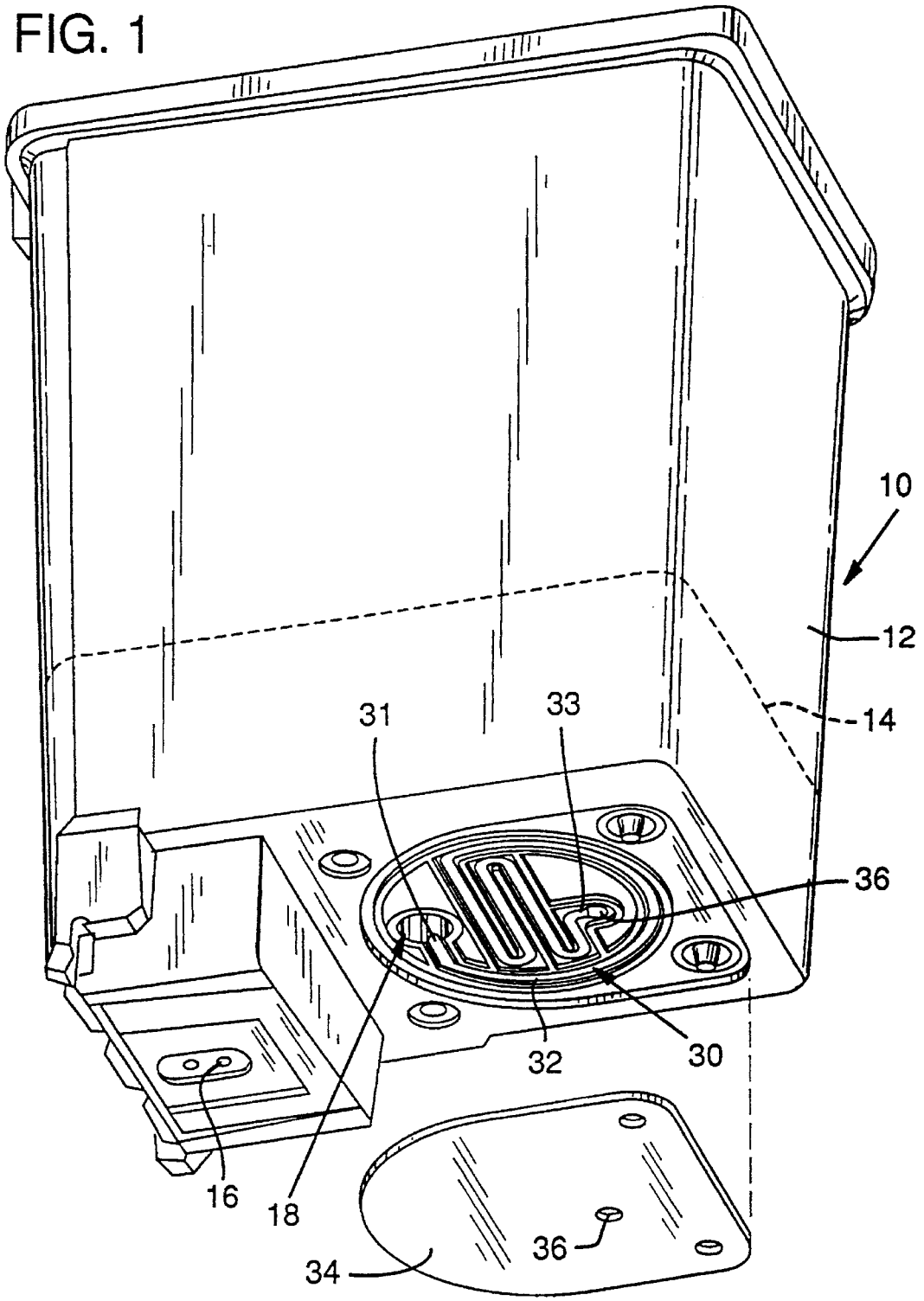
FIG. 1 is a partially exploded, bottom, isometric view of an ink pen in accordance with one embodiment of the present invention.

An ink pen in accordance with a preferred embodiment of the present invention is illustrated in FIG. 1 as reference numeral 10. The ink pen 10 has a reservoir 12 for storing a supply of ink 14. The reservoir is in fluid communication 16 with a print head which ejects ink drops onto a printing surface to form characters and images. The ink within the reservoir is subject to an initial back pressure to prevent the ink from drooling through the print head.

To maintain the back pressure within a desired range, the reservoir 12 is provided with a bubble generator 18 which allows fluid communication between the interior of the reservoir and a make up fluid, such as, the ambient atmosphere. When the back pressure is within the desired range the bubble generator is sealed with a quantity of ink. However, when the back pressure exceeds the desired range, the back pressure overcomes the capillary forces of the liquid seal and allows the make up fluid, ambient air in the illustrated embodiments, to bubble into the reservoir to reduce the back pressure. When the back pressure returns to the appropriate level, the liquid seal reforms to prevent further ingress of the make up fluid.

Figure 3:
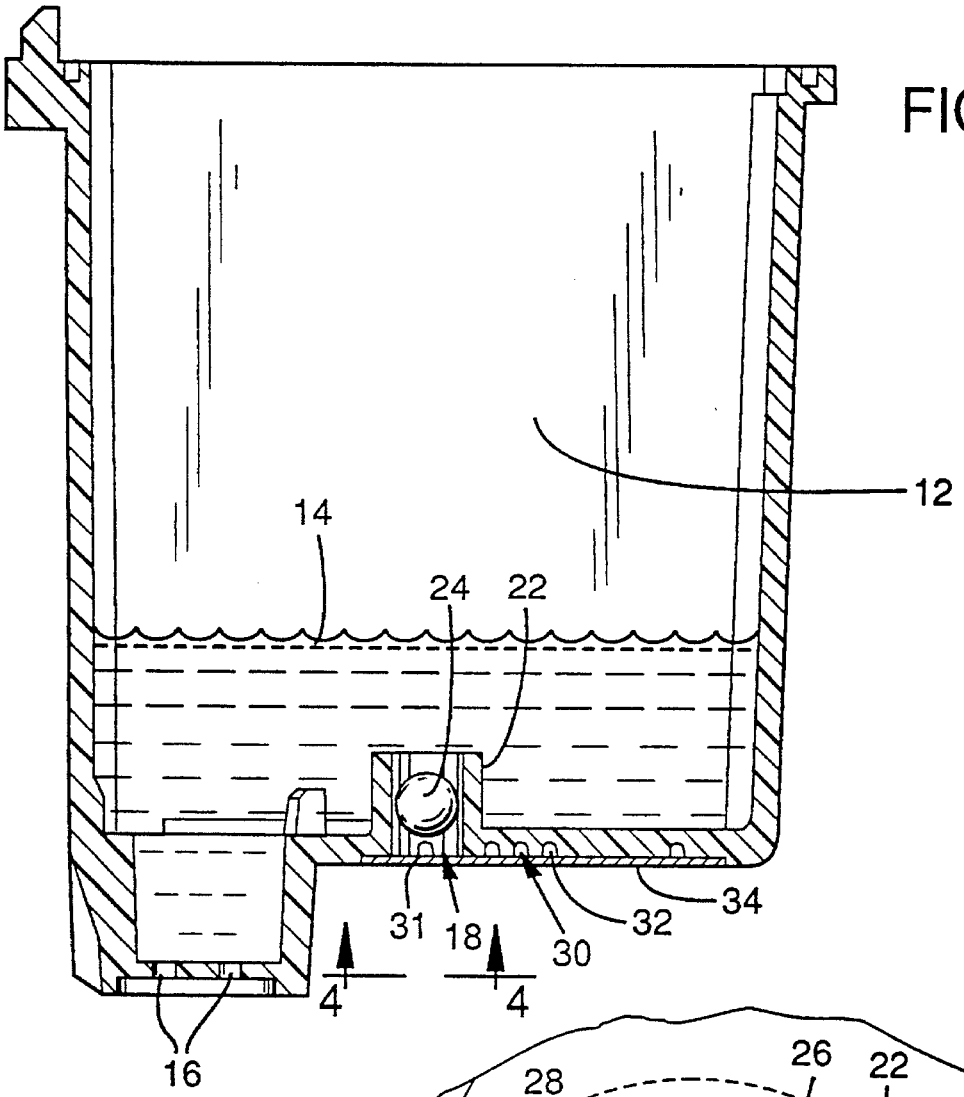
FIG. 3 is a cross sectional view taken along line 3—3 in FIG. 2.
Figure 4:
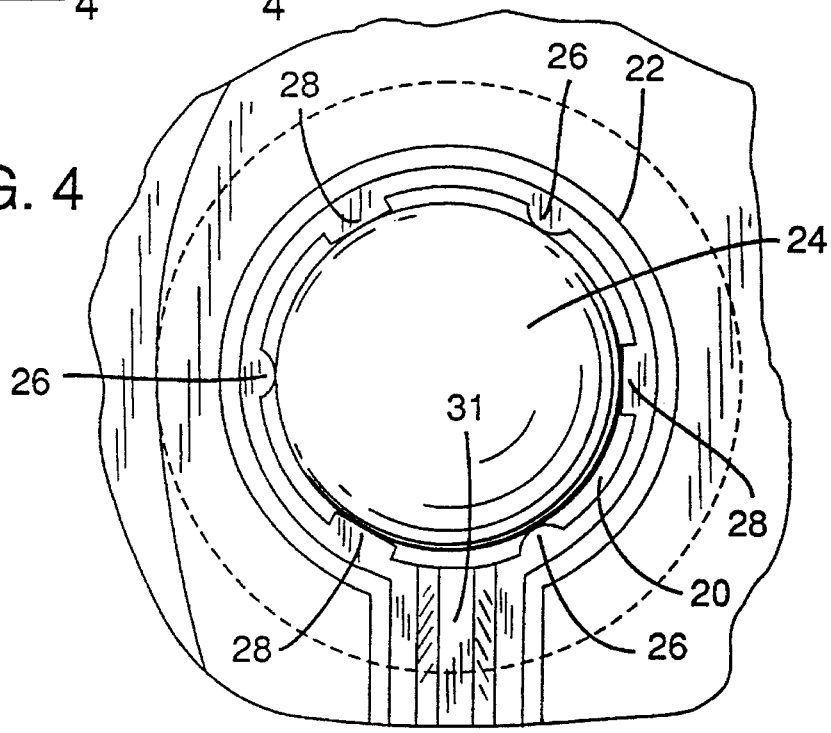
FIG. 4 is a bottom view of the bubble generator and capillary member of the embodiment illustrated in FIG. 1.

As illustrated in FIG. 3, the bubble generator 18 consists of a tubular boss 22 and a sphere 24 mounted concentrically within the boss. The outside diameter of the sphere 24 is smaller than the inside diameter of the boss 22 to define an annular orifice 20 (seen in FIG. 4). In the illustrated embodiment, the sphere is maintained within the boss by a number of raised crush ribs 26 formed around the interior of the boss. In this manner the sphere 24 can be easily press fit into the boss 22 and firmly maintained in position by the crush ribs 26. Additional raised ribs 28 are also provided to help maintain the sphere in position away from the inside wall of the boss. In an alternative, and preferred embodiment, there are six raised ribs and no crush ribs. The raised ribs are sized to provide the necessary interference for a press fit to maintain the sphere within the boss and provide the necessary clearance from the inside wall of the boss.

The sphere 24 serves as a capillary member to maintain a quantity of ink within the boss 22. As a result, even when the pen is oriented such that the boss is not submerged in the reservoir ink, a quantity of ink is trapped within the boss. Due to the curved surface of the sphere, the gap between the exterior surface of the sphere and the inner wall of the boss is smallest at the orifice and increases as the distance from the orifice increases. This geometry, coupled with the capillarity of the ink, constantly urges the trapped quantity of ink toward the orifice-the smallest portion of the gap—to provide a robust seal.

Figure 2:
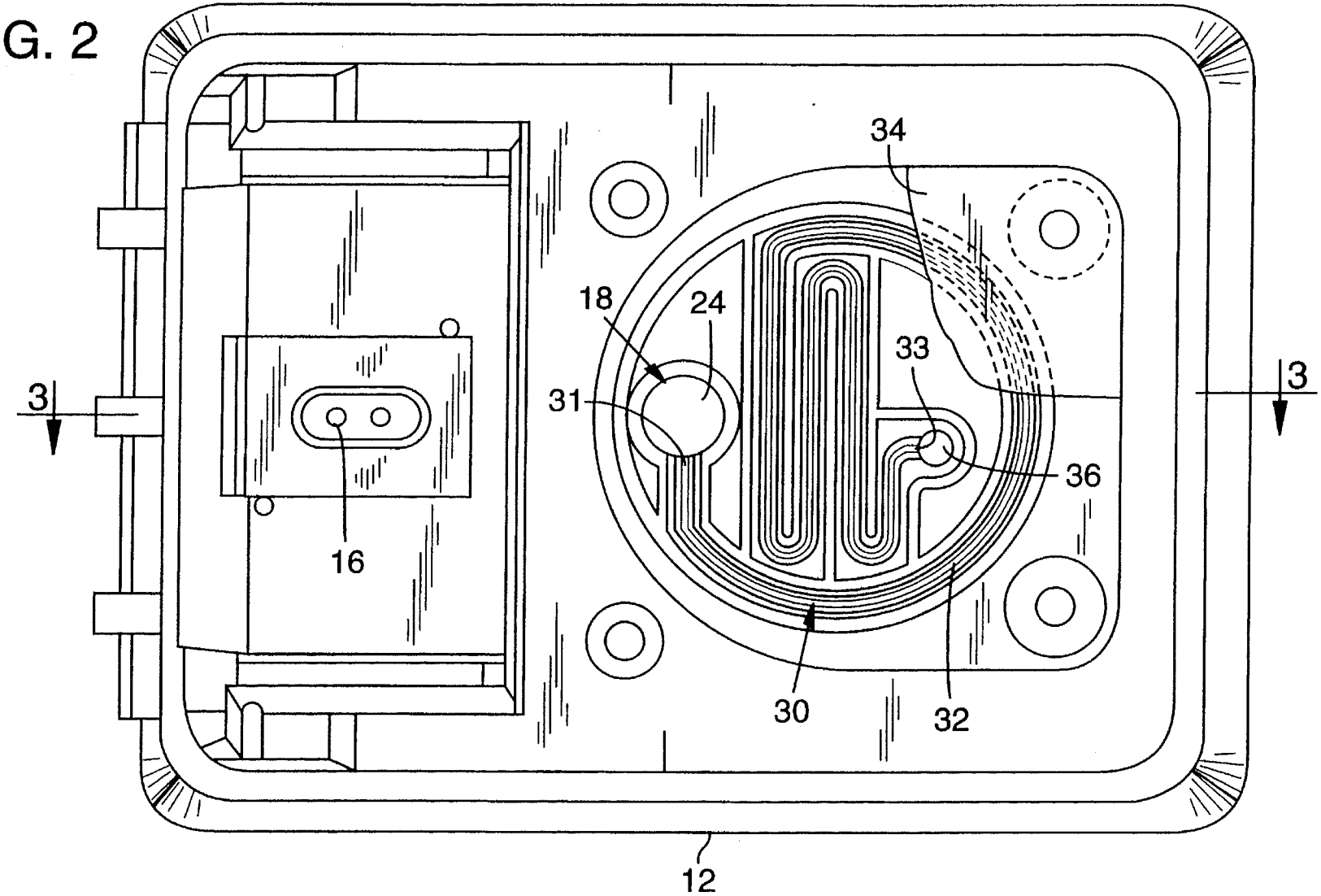
FIG. 2 is bottom view of the ink pen of FIG. 1.

To prevent the trapped quantity of ink from drying or solidifying as a result of prolonged exposure to the atmosphere, the bubble generator is provided with an inlet labyrinth 30 which serves as a vapor barrier. The inlet labyrinth, best seen in FIGS. 1 and 2, is a path through which the ambient air must travel before contacting the trapped ink. The proximal end 31 of the labyrinth opens to the boss and the distal end 33 opens to ambient air. The length of the labyrinth is sealed from both the ambient and the reservoir. As a result, the humidity within the labyrinth varies along its length from approximately 100% at the proximal end 31 to approximately ambient at the distal end 33. This humidity gradient serves to shield the trapped ink from direct contact with ambient air and prevent the trapped ink from drying or solidifying.

The inlet labyrinth is a path having a semicircular cross section. The ratio of the cross sectional area to length of the inlet labyrinth should be such that the volume of air in the inlet labyrinth effectively blocks convective mass transfer. Diffusive vapor losses are driven by the partial pressure gradients through the inlet labyrinth. As indicated by Fick's Laws of Diffusion, these losses are proportional to the cross sectional area of the inlet labyrinth and inversely proportional to the length of the inlet labyrinth. The appropriate dimensions of an inlet labyrinth for any particular embodiment can be empirically determined by one skilled in the art.

As seen in FIGS. 2, and 3, the inlet labyrinth in the illustrated embodiment, is a trough 32 molded directly into the external surface of the reservoir 12. A cover 34 is attached to the reservoir to seal the trough 32 between its ends. A hole 36 through the cover at the distal end 33 of the trough 32 provides fluid communication between the trough and the ambient atmosphere. The circuitous configuration of the trough conserves space and reduces the size of the cover.

The inlet labyrinth 30 also serves as an overflow receptacle. If the pen is subject to an environmental change, such as a temperature or altitude variation, which causes the fluid volume within the reservoir to expand beyond the capacity of the reservoir, the excess ink can exit the reservoir via the bubble generator and enter the inlet labyrinth 30. Subsequently, when the environmental conditions return to normal, or ink is depleted from the reservoir, the excess ink can reenter the reservoir.

To ensure that excess ink in the labyrinth will completely reenter the reservoir, it is preferable that the largest cross-sectional dimension of the labyrinth is small enough to allow the ink to form a complete meniscus across the cross section at any location along the labyrinth. Otherwise, small amounts or beads of ink may become stranded in the labyrinth. In the illustrated embodiment, the maximum cross-sectional dimension of the labyrinth is approximately 0.89 mm.

The effectiveness of the illustrated ink pen depends on the appropriate sizing of the orifice 20, the boss 22, and the sphere 24 to ensure that the liquid seal gives way below the maximum allowable back pressure and is reinstated above the minimum allowable back pressure. The exact dimensions of the various elements of the ink pen will depend on a number of factors, such as the surface energies of the materials, the density and surface tension of the ink, the desired range of back pressures, and the shape of the orifice. Once these factors are known, the proper dimensions can be readily calculated or empirically determined by one skilled in the art.

In the illustrated embodiment, the desired range of back pressures is from 10 cm to 16 cm water column and the ink used has a density of approximately 1 g/cm$^3$ and a surface tension of approximately 60.2 dynes/cm. A stainless steel sphere having a diameter of approximately 3.18 mm and a polysulfone boss having an inside diameter of between 3.34 mm and 3.39 mm have been found to be satisfactory. Of course, each particular embodiment of the invention may require different dimensions according to its particular parameters.

Figure 5:
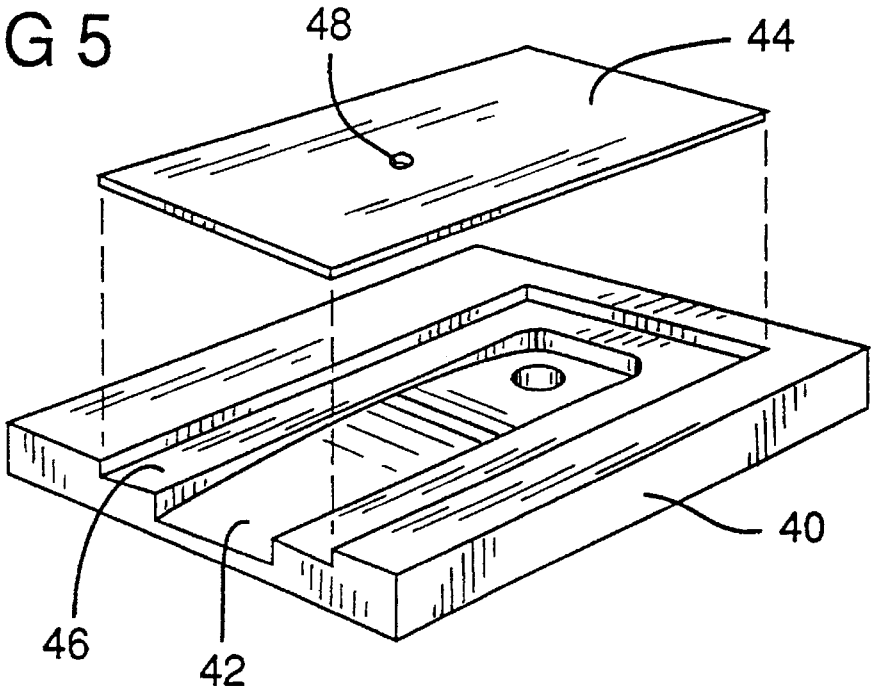
FIG. 5 is an exploded, isometric view of an alternative embodiment of a bubble generator and capillary member in accordance with the present invention.
Figure 6:
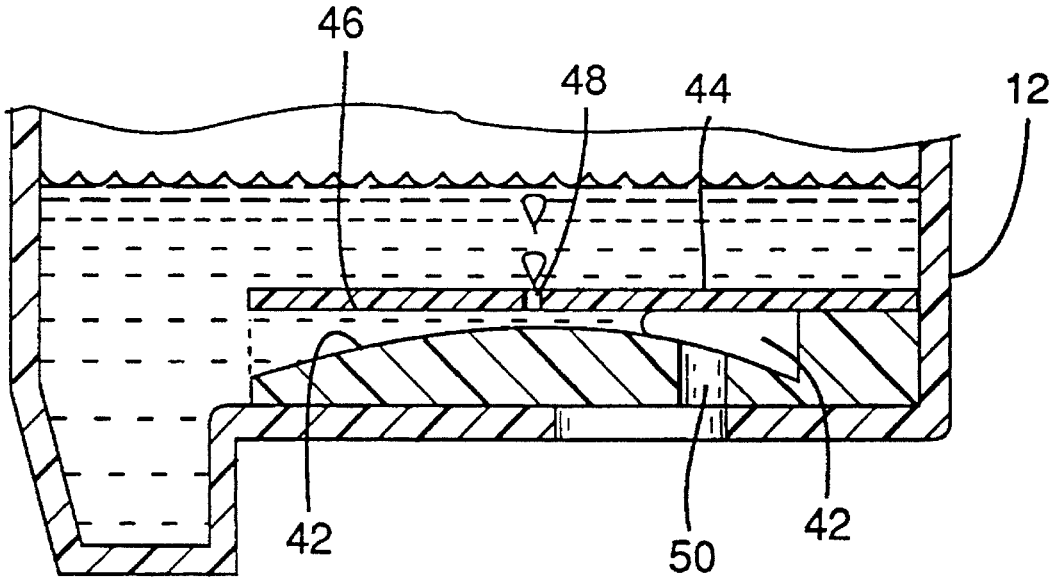
FIG. 6 is a side view cross section of the embodiment illustrated in FIG. 5.

A bubble generator in accordance with an alternative embodiment of the invention, illustrated in FIGS. 5 and 6, has a base plate 40 which is attached to the inside of an ink pen reservoir 12. The base plate 40 is provided with an arched trough 42 and a recess 46. A cover plate 44 fits within the recess 46 to cover the trough 42. The cover plate 44 has an orifice 48 directly over the peak of the arched trough. One end of the trough is open to the ink within the interior of the reservoir and the other end is vented via opening 50 to the ambient atmosphere. As a result, the ink is drawn, by capillary forces, into the trough to form a liquid seal under the orifice 48.

Regardless of the orientation of the ink pen, a quantity of ink is trapped within the trough by capillary forces. As a result of the arched shape of the trough, the cross sectional area of the trough is at a minimum at the peak of the arch adjacent the orifice. This geometry, in combination with capillarity of the ink, urges the trapped ink toward the peak of the arch and, hence, the orifice to maintain a strong and robust seal. The trough is sized such that when the back pressure exceeds the working range of the print head, the ambient air pushes the liquid seal up the trough, and allows ambient air to bubble through the orifice into the reservoir to lower the back pressure. As the back pressure returns to the desired range, the capillarity of the ink causes it to move into the trough to reseal the orifice.

In the illustrated embodiments, curved capillary members, such as a sphere or an arched trough, are used to urge a quantity of ink toward an orifice. However, in other embodiments the capillary member need not be curved. For example, a cylinder concentrically mounted within a boss or a flat trough could also serve to trap a quantity of ink adjacent an orifice.

Figure 7:
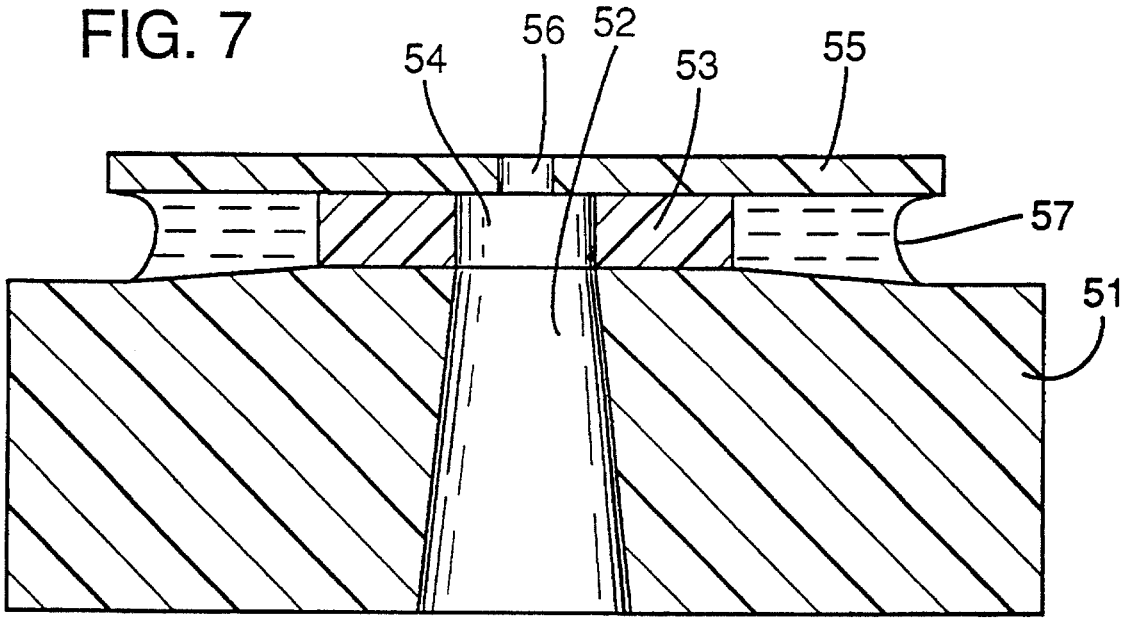
FIG. 7 is a side, cross-sectional view of an alternative embodiment of a bubble generator capillary member in accordance with the present invention.
Figure 8:
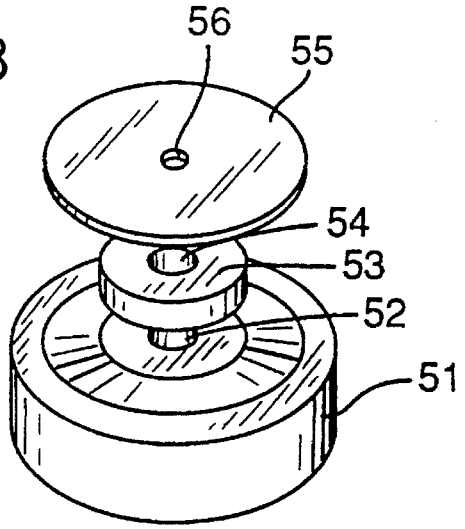
FIG. 8 is an exploded, isometric view of the alternative embodiment of FIG. 7.

In yet another embodiment, shown in FIGS. 7 and 8, a fibrous or porous material 53 forms an ink path between the bubble generator and the capillary reservoir 57. The purpose of the fibrous or porous material is to prevent the bubble generator make up fluid, entering through orifii 52 and 54 from escaping into the capillary reservoir 57 and depleting the supply of ink in the capillary reservoir 57. Orifice 54 is sized such that the capillary forces in the orifice 54 are stronger than those in the capillary reservoir 57 and draw liquid from the reservoir, through the fibrous material to replenish the seal. The appropriate sizes for the orifii and capillary reservoir can be determined by one skilled in the art.

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

What is claimed is:

1. A pen for an ink-jet printer comprising:

a reservoir having an interior for holding ink and having an orifice formed therein to allow fluid communication between the interior of said reservoir and a volume of make up fluid; and a capillary member connected to the reservoir and immovably positioned, said capillary member having a surface structure defining a gap between the surface and the reservoir to retain by capillarity a quantity of ink adjacent said orifice, whereby the gap diminishes in size from the ink in the reservoir to the orifice so that a portion of said quantity of ink is drawn into said orifice to seal the orifice.

2. The pen of claim 1 in which the make up fluid is ambient air.

3. The pen of claim 1 further comprising a chamber for holding a volume of make up fluid, said chamber being in fluid communication with the orifice and with ambient atmosphere.

4. The pen of claim 1 wherein the capillary member is a plate.

5. The pen of claim 14 wherein the plate has a curved surface.

6. The pen of claim 1 wherein the capillary member is a sphere.

7. A pen for an ink-jet printer comprising:

a reservoir having an interior for holding ink and having an orifice formed therein to allow fluid communication between the interior of said reservoir and a volume of make up fluid;

a capillary member connected to the reservoir and immovably positioned adjacent said orifice, said capillary member having a surface structure defining a gap between the surface and the reservoir to retain by capillarity a quantity of ink adjacent said orifice, whereby the gap diminishes in size from the ink in the reservoir to the orifice so that a portion of said quantity of ink is drawn into said orifice to seal the orifice; and means attached to said reservoir for preventing exposure of said quantity of liquid to ambient humidity.

8. A pen for an ink-jet printer comprising:

a reservoir for holding a supply of ink and having a bottom and a top;

a print head mounted to the bottom of the reservoir for ejecting ink from the reservoir;

a bubble generator orifice in said reservoir allowing fluid communication between said ink supply and ambient atmosphere; and a capillary member immovably connected to the bottom of the reservoir adjacent said orifice, said capillary member having a surface structure to define a gap between the surface and the reservoir to retain by capillarity a quantity of ink within the gap adjacent said orifice.

9. The ink pen of claim 8 wherein the capillary member is shaped so that the gap is larger in size at a portion of the gap proximal to said ink supply and smaller in size at a portion of the gad proximal to said orifice to urge supply ink into the gap toward said orifice.

10. A pen for an ink-jet printer comprising:

a reservoir for holding a supply of ink and having a bottom and a top;

a print head mounted to the bottom of the reservoir for ejecting ink from the reservoir;

a bubble generator orifice between a surface of the pen and the reservoir allowing fluid communication between said ink supply and ambient atmosphere;

a capillary member immovably positioned at the bottom of the reservoir adjacent said orifice, said capillary member having a surface structure to define a gap between the surface end the reservoir to retain by capillarity a quantity of ink within the gap adjacent said orifice; and an inlet labyrinth connected to the reservoir and having a proximal end adjacent said orifice, a mid portion, and a distal end open to ambient atmosphere, said mid portion being elongated to create a humidity gradient between the proximal and distal ends.

11. A pen for an ink-jet printer comprising:

a reservoir for holding ink;

a boss associated with said reservoir, said boss having an inside part defining a passage for allowing fluid communication between said ink and ambient atmosphere; and a capillary member having a surface structure fixed within the boss to define a gap between the capillary member surface structure and the inside part of the boss so that a quantity of ink is retained by capillarity in said gap, the gap being contiguous with the passage.

12. The pen of claim 11 in which the capillary member has a cylindrical portion within the boss, and the gap is defined between the cylindrical portion and the inside part of the boss.

13. The pen of claim 11 wherein the capillary member is a sphere.

14. A pen for an ink-jet printer comprising:

a reservoir for holding ink;

a tubular boss associated with said reservoir, said boss having an interior opening for allowing fluid communication between said ink and ambient;

a plurality of ribs connected to the boss and distributed about the opening of the boss and extending into the opening;

a sphere positioned within said boss and immovably fit between said ribs to define a gap between the sphere and the boss, the size of the gap being such that a quantity of ink is retained within the gap by capillarity; and an inlet labyrinth connected to the reservoir, said inlet labyrinth having a proximal end open to said boss interior opening and a distal end open to ambient atmosphere wherein said labyrinth maintains the humidity near the proximal end at approximately 100 percent.

15. A method of forming a pressure-sensitive seal at an orifice that permits the passage of air into an ink reservoir of an ink pen comprising the steps of:

forming a gap defined entirely by smooth fixed surfaces adjacent said orifice and of a size such that liquid is trapped by capillarity within the gap;

submerging the gap in a liquid, said gap being sized such that when submerged, a quantity of liquid becomes trapped in the gap; and configuring the surfaces defining the gap to provide a smoothly varying gap width with the gap width narrowing toward the orifice, thereby to guide the trapped quantity of liquid into the orifice to form a pressure-sensitive seal.

16. The method of claim 15 including the step of locating the gap so that the orifice opens into the gap, and air passing through the orifice into the reservoir passes through the gap.

* * * * *